US010036248B2

(12) United States Patent
Defibaugh et al.

(10) Patent No.: US 10,036,248 B2
(45) Date of Patent: Jul. 31, 2018

(54) CUTTER HEAD FOR LONGWALL SHEARER

(71) Applicants: Joy MM Delaware, Inc., Wilmington, DE (US); The United States of America, as Represented by the Secretary of the Department of Health and Human Services, Washington, DC (US)

(72) Inventors: Joseph Defibaugh, Franklin, PA (US); Hugo Camargo, South Park, PA (US); Junyi Yang, Cupertino, CA (US)

(73) Assignees: Joy Global Underground Mining LLC, Warrendale, PA (US); The United States of America, as represented by the Secretary of the Dep. of Health and Human Services, Washington, DC (US)

( * ) Notice: Subject to any disclaimer, the term of this patent is extended or adjusted under 35 U.S.C. 154(b) by 83 days.

(21) Appl. No.: 14/880,052

(22) Filed: Oct. 9, 2015

(65) Prior Publication Data

US 2016/0102549 A1 Apr. 14, 2016

Related U.S. Application Data

(60) Provisional application No. 62/062,440, filed on Oct. 10, 2014.

(51) Int. Cl.
*E21C 35/18* (2006.01)
*E21C 25/10* (2006.01)

(52) U.S. Cl.
CPC ..... *E21C 25/10* (2013.01); *E21C 35/18* (2013.01)

(58) Field of Classification Search
CPC ... E21C 35/18; E21C 2035/1826; E21C 25/10
See application file for complete search history.

(56) References Cited

U.S. PATENT DOCUMENTS 3,085,795 A 4/1963 Snipe et al.
3,904,246 A 9/1975 Gandy et al.
(Continued)

FOREIGN PATENT DOCUMENTS

CN 201972701 U 9/2011
WO 2004081345 A1 9/2004

OTHER PUBLICATIONS

International Search Report and Written Opinion for Application No. PCT/US2015/055006 dated Jan. 7, 2016 (7 pages).
(Continued)

*Primary Examiner* — John J Kreck
(74) *Attorney, Agent, or Firm* — Michael Best & Friedrich LLP

(57) ABSTRACT

A cutter head for a mining machine includes a first end and a second end with a drum axis extending between the first and the second ends. The cutter head also includes a web coupled to the second end of the drum. The web includes a plurality of arcuate apertures. Each arcuate aperture extends through an angle about the drum axis. The cutter head further includes a plurality of first ribs coupled to the web. Each of the first ribs is positioned between adjacent arcuate apertures. The cutter head also includes a plurality of second ribs coupled to the web. Each of the second ribs extend across one of the plurality of arcuate apertures. A first angle that extends between one of the first ribs and an adjacent one of the second ribs is different than a second angle extending between the one first rib and another adjacent second rib.

20 Claims, 10 Drawing Sheets

(56) References Cited

U.S. PATENT DOCUMENTS

| | | | | |
|---|---|---|---|---|
| 4,218,095 | A | 8/1980 | Jaromin et al. | |
| 4,290,653 | A | 9/1981 | Lagowski | |
| 4,358,161 | A | 11/1982 | Needham | |
| 5,322,351 | A * | 6/1994 | Lent | E21C 35/193 299/102 |
| 5,904,408 | A * | 5/1999 | Olson | B28D 1/188 299/102 |
| 6,779,850 | B1 | 8/2004 | Schibeci et al. | |
| 6,799,850 | B2 * | 10/2004 | Hong | H04N 9/3117 345/39 |
| 2008/0111418 | A1 | 5/2008 | Helsel et al. | |
| 2012/0175939 | A1 * | 7/2012 | O'Neill | B02C 13/2804 299/81.3 |
| 2014/0265528 | A1 * | 9/2014 | O'Neill | E21C 1/00 299/42 |

OTHER PUBLICATIONS

Various Cutting Drums, available on or before Oct. 9, 2014, (13 pages).

* cited by examiner

CUTTER HEAD FOR LONGWALL SHEARER

CROSS-REFERENCE TO RELATED APPLICATION

This application claims the benefit of prior-filed, co-pending U.S. Provisional Patent Application No. 62/062,440, filed Oct. 10, 2014, the entire contents of which are incorporated by reference herein.

STATEMENT REGARDING FEDERALLY SPONSORED RESEARCH OR DEVELOPMENT

This invention was made with government support by the Centers for Disease Control and Prevention (CDC), National Institute for Occupational Safety and Health (NIOSH). The government has certain rights in the invention.

BACKGROUND

The present invention relates to the field of mining machines. Specifically, the present invention relates to a cutting drum for a longwall shearer.

A conventional shearer drum includes cutting bits positioned within bit holders. The drum includes a spiral vane having a loading fence extending along the outer perimeter of the vane. The fence urges cut material into the space between the vane surfaces, and the vane carries cut material from the mine face to a face conveyor behind the shearer drum. The vane includes notches formed along the loading fence, and bit holders are coupled to the vane in the notches.

SUMMARY

In one aspect, the invention provides a cutter head for a mining machine. The cutter head includes a drum having a first end, a second end, and an outer surface. The drum is rotatable about a drum axis extending between the first end and the second end. The cutter head also includes a vane coupled to the outer cylindrical surface extending away from the drum axis and a cutting bit assembly positioned adjacent the vane. The cutting bit assembly includes a bit and a holder block. The bit includes a tip portion and a shank portion. The shank portion is received within the holder block along a central axis. The holder block includes a forward end adjacent the tip portion, a rear end opposite the forward end, and a transverse opening positioned between the forward end and the rear end. The transverse opening permits access to a rear end of the shank portion. The holder block further includes a rear opening. The cutter head further includes a gusset coupled to the vane and spaced from the rear end of the holder block. When the bit is broken, a portion of the bit is removable from the holder block through the rear opening and between the rear end of the holder block and the gusset.

In another aspect, the invention provides a cutter head for a mining machine. The cutter head includes a drum defining a cylindrical portion having a first end and a second end with a drum axis extending between the first and the second ends. The cutter head also includes a web coupled to the second end of the drum and extending away from the drum axis. The web includes a plurality of arcuate apertures. Each arcuate aperture extends through an angle about the drum axis. The cutter head further includes a plurality of first ribs coupled to the web. Each of the first ribs is positioned between adjacent arcuate apertures. The cutter head also includes a plurality of second ribs coupled to the web. Each of the second ribs extend across one of the plurality of arcuate apertures. A first angle that extends between one of the first ribs and an adjacent one of the second ribs is different than a second angle extending between the one first rib and another adjacent second rib.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof Unless specified or limited otherwise, the terms "mounted," "connected," "supported," and "coupled" and variations thereof are used broadly and encompass both direct and indirect mountings, connections, supports, and couplings.

Figure 1:
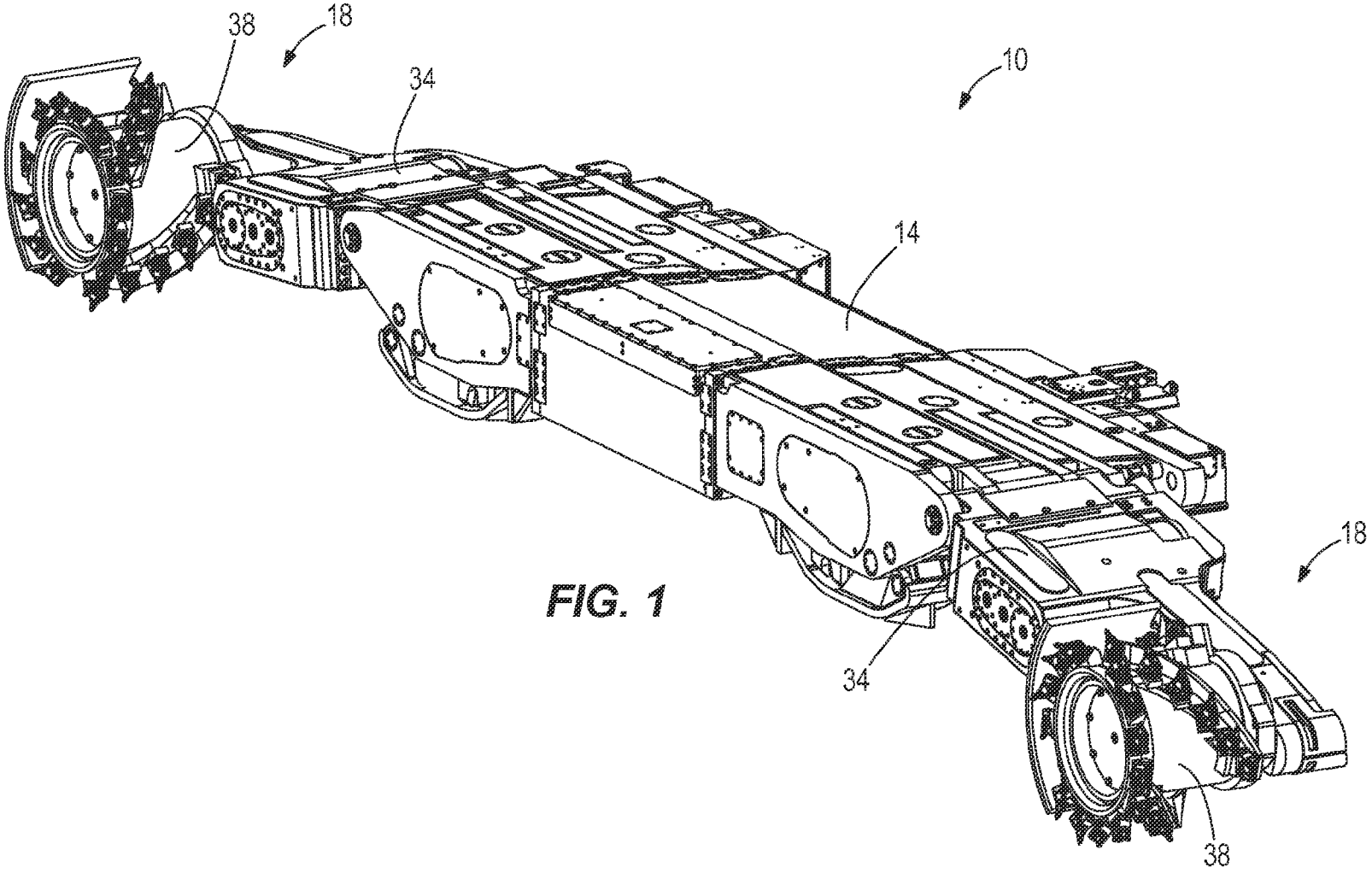
FIG. 1 is a front perspective view of a mining machine including a cutter head.
Figure 2:
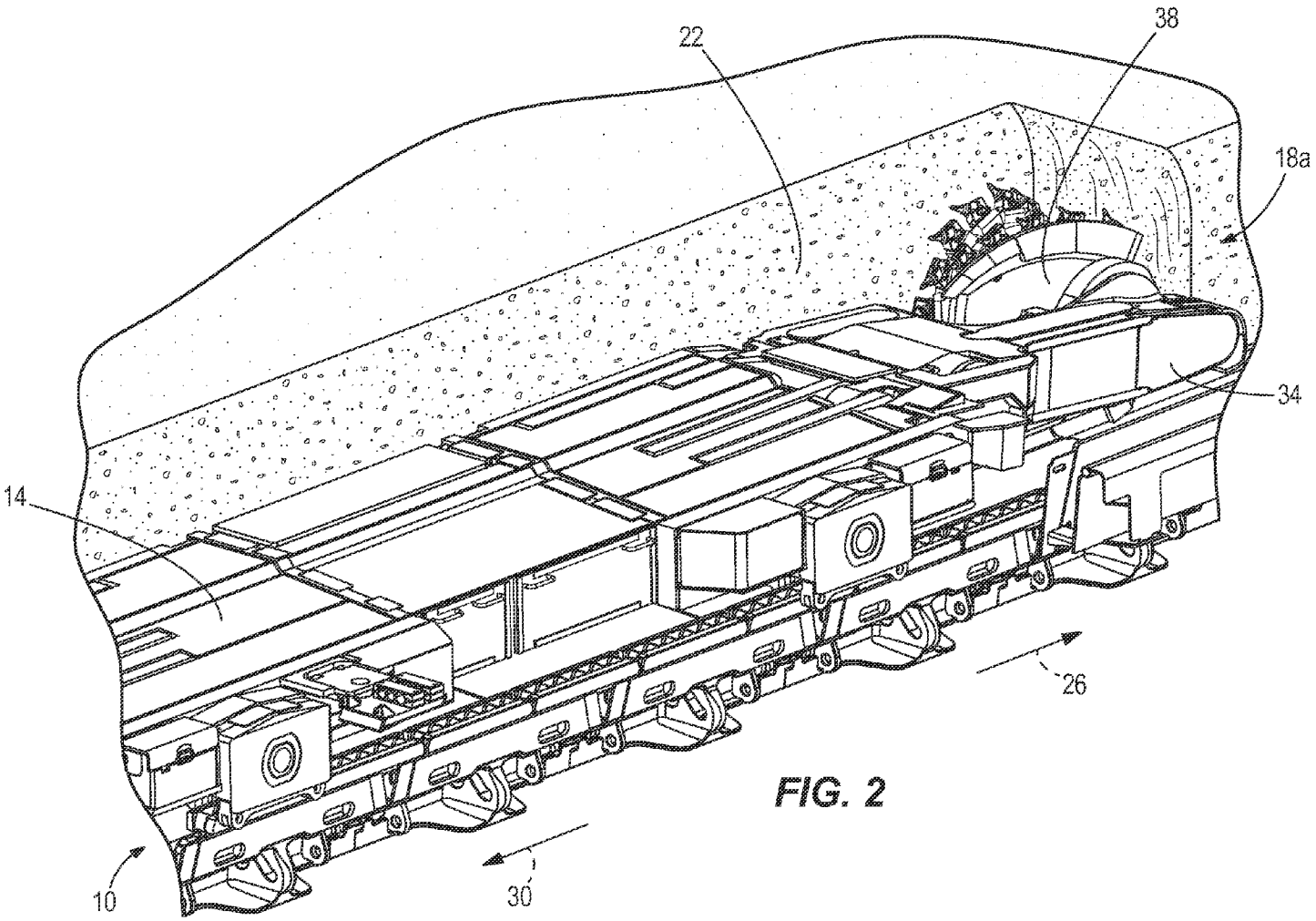
FIG. 2 is a rear perspective view of the mining machine of FIG. 1 with the cutter head engaging a mine face.

FIG. 1 illustrates a longwall shearer 10 including a frame or chassis 14 and a pair of cutting assemblies 18. As shown in FIG. 2, the chassis 14 is configured to tram along a mine face 22 in a first direction 26 and a second direction 30 opposite the first direction 26. As the chassis 14 moves in the first direction 26, a first cutting assembly **18*a* is in a leading position and a second cutting assembly (not shown) is in a trailing position. In one embodiment, the first cutting assembly 18*a* is elevated to cut material (e.g., coal or other minerals) from an upper portion of the mine face 22, while the second cutting assembly is in a lower position to cut material from a lower portion of the mine face 22**.

Each cutting assembly 18 includes a ranging arm 34 and a cutter head 38. One end of the ranging arm 34 is pivotably coupled to the chassis 14 and another end supports the cutter head 38 for rotation. The ranging arm 34 is pivoted related to the chassis 14 in order to position the cutter head 38, including raising and lowering the cutter head 38.

Figure 3:
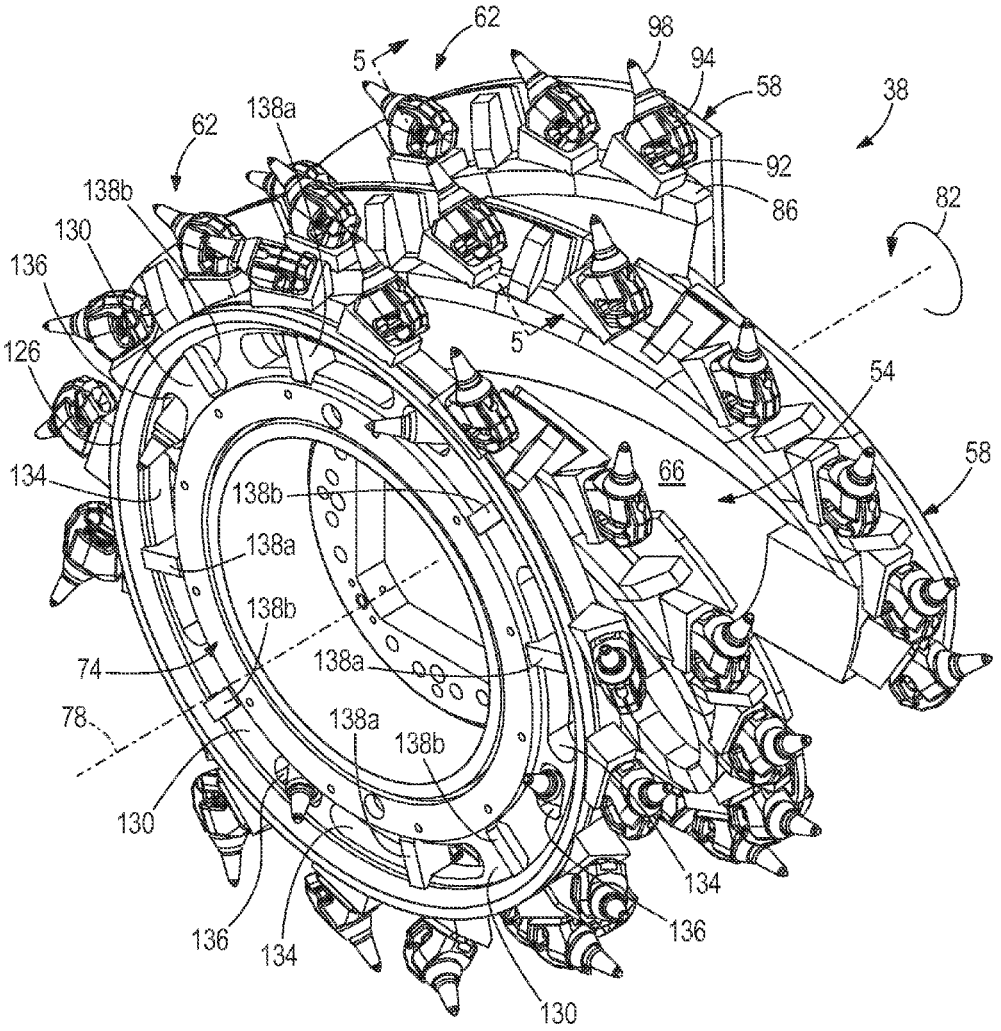
FIG. 3 is a front perspective view of the cutter head of FIG. 1.
Figure 4:
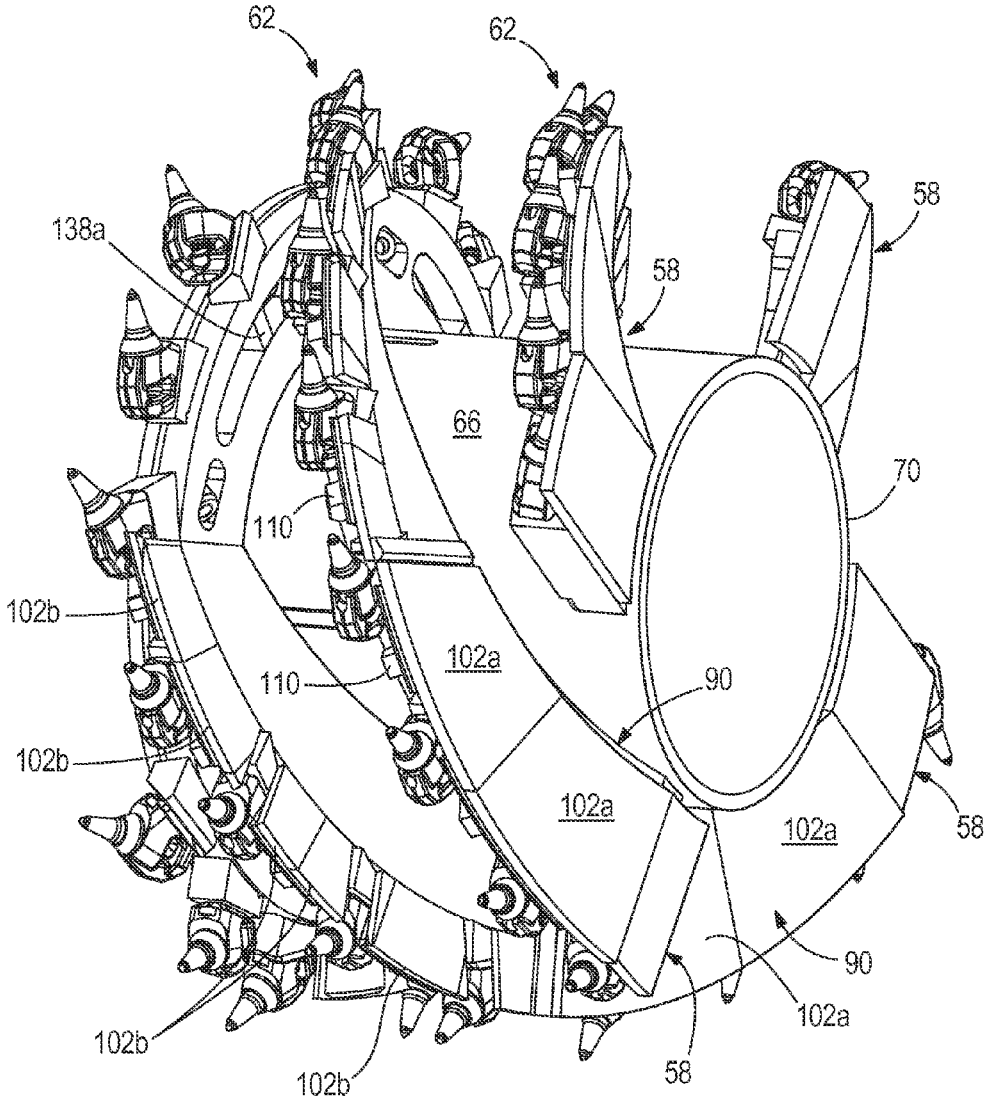
FIG. 4 is a rear perspective view of the cutter head of FIG. 3.

FIGS. 3 and 4 illustrate the cutter head 38. The cutter head 38 includes a drum 54, vanes 58, and a plurality of cutting bit assemblies 62 coupled to the vanes 58. In the illustrated embodiment, the drum 54 has a generally cylindrical outer surface or portion 66. The drum 54 has a first end or discharge end 70 (FIG. 4) and a second end or face end 74, and a drum axis 78 extends between the discharge end 70 and the face end 74. The discharge end 70 is pivotably coupled to the ranging arm 34, and the face end 74 engages the mine face 22 (FIG. 2). The drum 54 rotates about the drum axis 78 in at least a first direction 82 so that the tips of the cutting bit assemblies 62 engage the mine face 22.

The vanes 58 are connected to the drum 54 (e.g., by welding) and extend in a spiral or helical manner along the periphery or outer surface of the drum 54, along at least a portion of the drum axis 78 between the discharge end 70 and the face end 74. In the illustrated embodiment, the cutter head 38 includes four vanes 58 (FIG. 4) substantially perpendicular to the drum axis 78; in other embodiments, the cutter head 38 may include one vane 58, or it may include fewer or more vanes 58 than the illustrated embodiment.

Each vane 58 defines an edge surface 86 (FIG. 3) proximate an outer perimeter of the vane 58 and a loading surface 90 (FIG. 4) extending perpendicular from the outer surface of the cylindrical portion 66 of the drum 54. The edge surface 86 defines a helical plane that is generally parallel to the drum axis 78. The loading surface 90 is shaped or contoured to match the helical shape of the vane 58. As the drum 34 rotates, the vane 58 urges the cut material from the face end 74 toward the discharge end 70, where the cut material is deposited onto a face conveyor (not shown) below the chassis 10 (FIG. 1).

Figure 5:
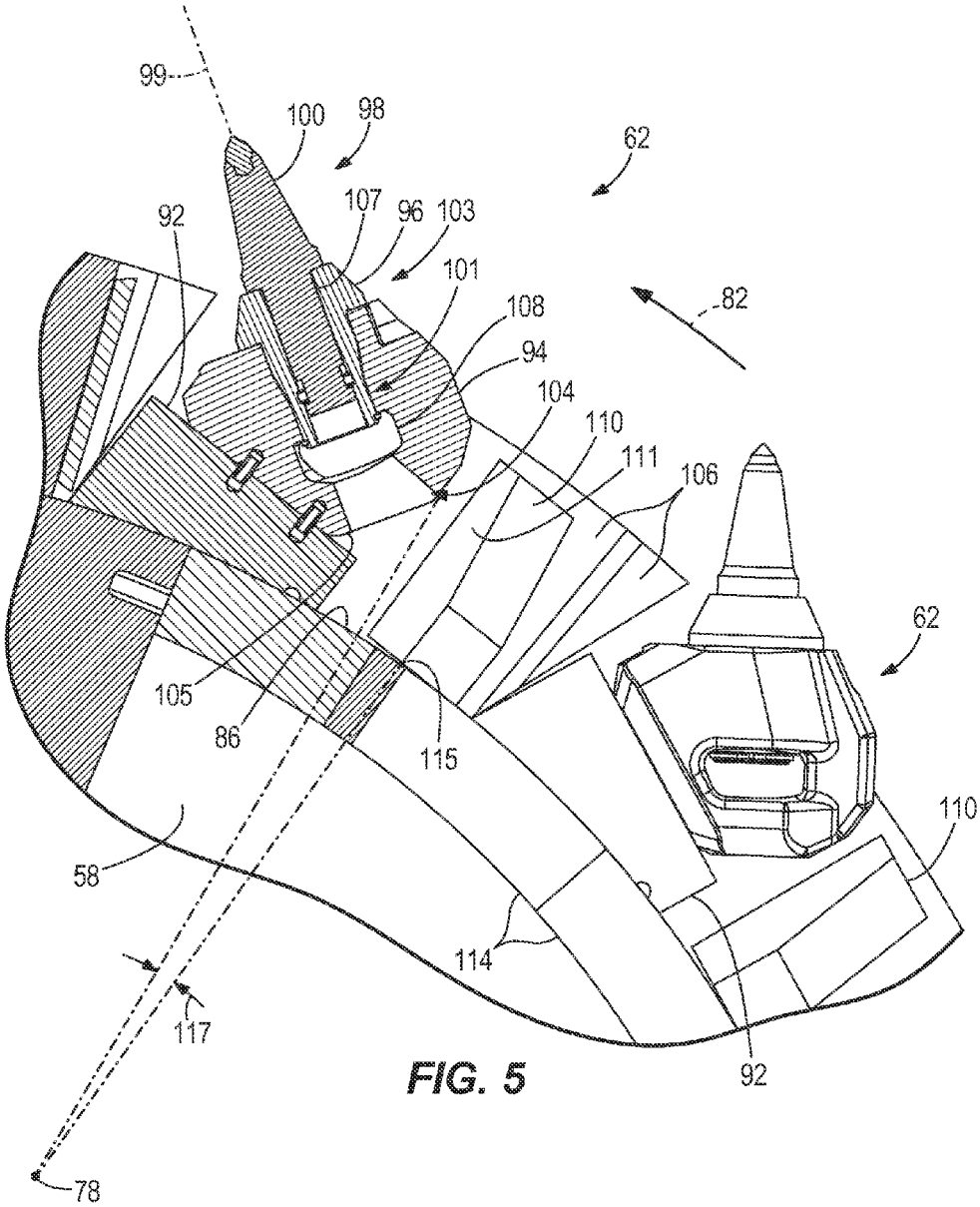
FIG. 5 is a section view of the cutter head of FIG. 3 taken along 5-5.

With reference to FIG. 5, the cutting bit assemblies 62 are coupled to a pedestal 92 connected to the edge surface 86. In one embodiment, each cutting bit assembly 62 includes a holder block 94, a sleeve 96, and a bit 98. In other embodiments, the sleeve 96 may be omitted. The bit 98 includes a tip or working end 100 that is adapted to engage the mine face 22 and a shank 107 that is removably secured within the holder block 94 along a central axis 99. In particular, the illustrated holder block 94 defines a through bore 101 that receives the shank 107, and the bit 98 may be removed and replaced (e.g., when the tip 100 is damaged or worn) by moving the bit 98 from either a forward end 103 or a rear end 104 (particularly if the bit 98 is broken) of the holder block 94. The rear end 104 includes a rear opening 105 to allow a portion of a broken bit 98 to be removed if necessary. In the illustrated embodiment, the block also includes a transverse opening 108 through which a rear end of the shank 107 is accessible. The rear end 104 is generally facing in a direction opposite the first direction 82 of rotation of the drum 54, whereas the forward end 103 is facing opposite the rear end 104. In the illustrated embodiment, the central axes 99 of the cutting bit assemblies 62 that are coupled to the vanes 58 are parallel to the ends 70, 74 (e.g., perpendicular to the drum axis 78), as shown in FIG. 6.

Figure 8:
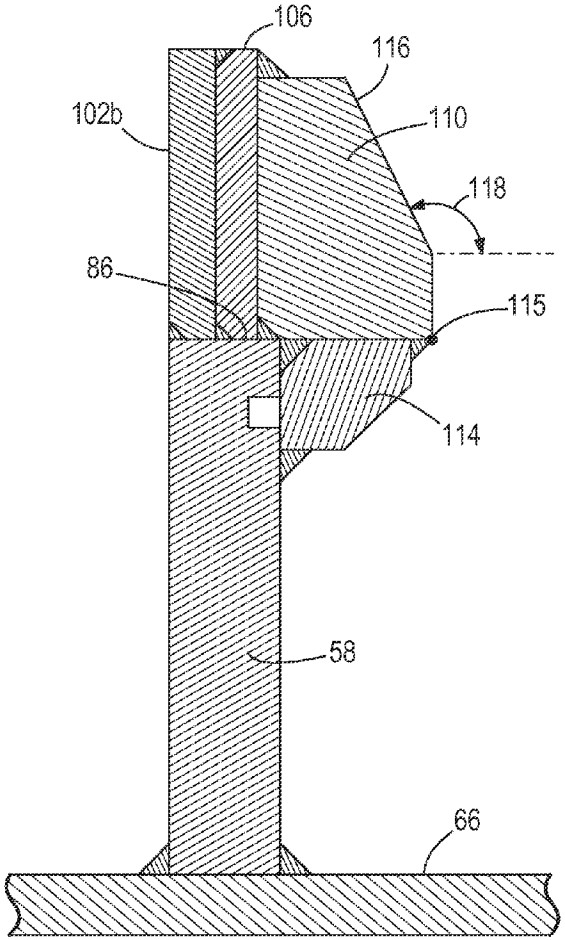
FIG. 8 is a section view of the planar projection of FIG. 6, viewed along section 8-8.

With reference to FIG. 4, a fence or loading plate 102 is coupled to the vane 58 and positioned on a trailing side of the cutting bit assembly 62. That is, the loading plate 102 is positioned away from the face end 74 of the drum 54, such that an adjacent holder block 94 is positioned between the loading plate 102 and the face end 74. The loading plates 102 facilitate the material cut from the mine face 22 to move onto the loading surface 90. A portion of the loading plates 102*a* positioned proximate the discharge end 70 are secured (e.g., by welding) to the side of the vane 58 in a lap configuration, at least partially forming the loading surface 90. Another portion of the loading plates 102*b* are secured (e.g., by welding) to the edge surface 86 such that an edge of the loading plate 102*b* abuts the edge surface 86 (FIG. 8). The loading plates 102*a* generally form a continuous surface, while the loading plates 102*b* are positioned between cutting bit assemblies 62 and are generally discontinuous relative to one another. In other embodiments, the loading plates 102*a*, 102*b* may be secured to the vane 58 in another manner.

Figure 6:
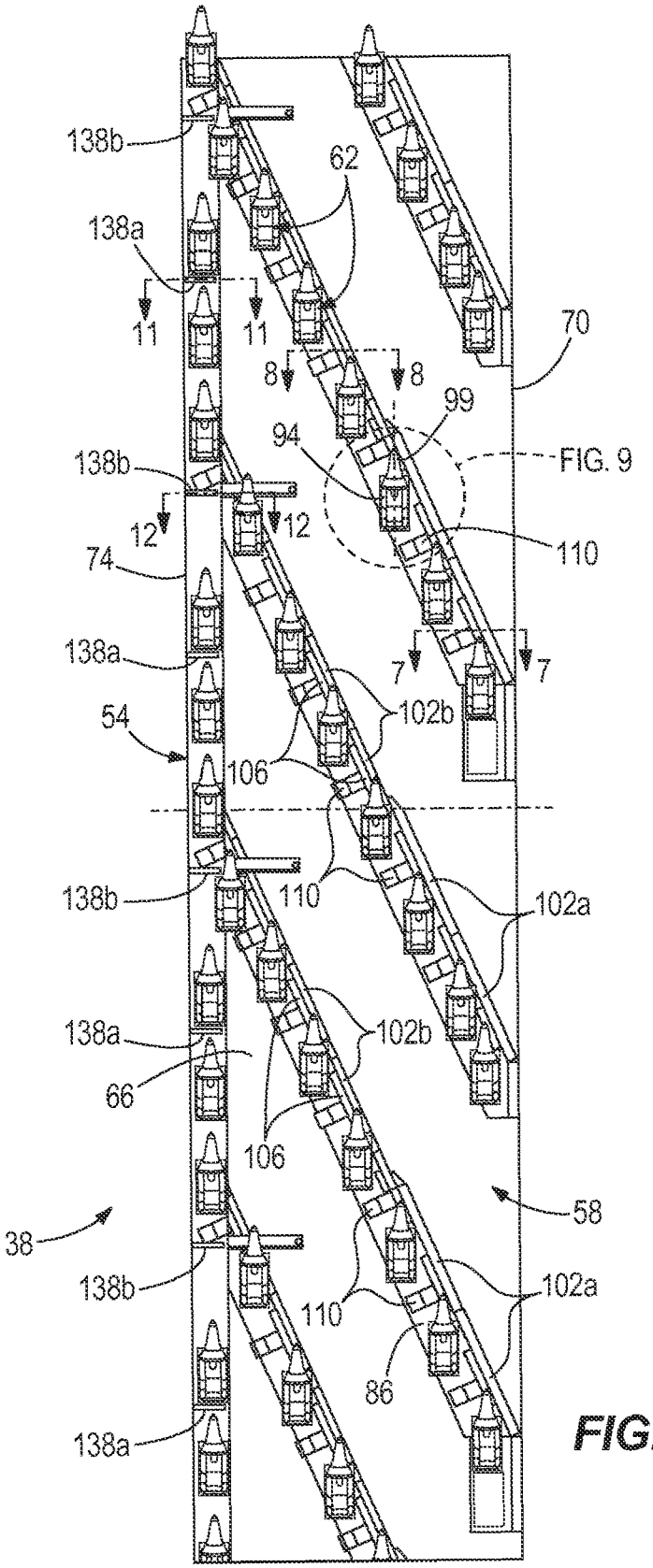
FIG. 6 is a side view of a planar projection of an outer surface of the cutter head of FIG. 3
Figure 7:
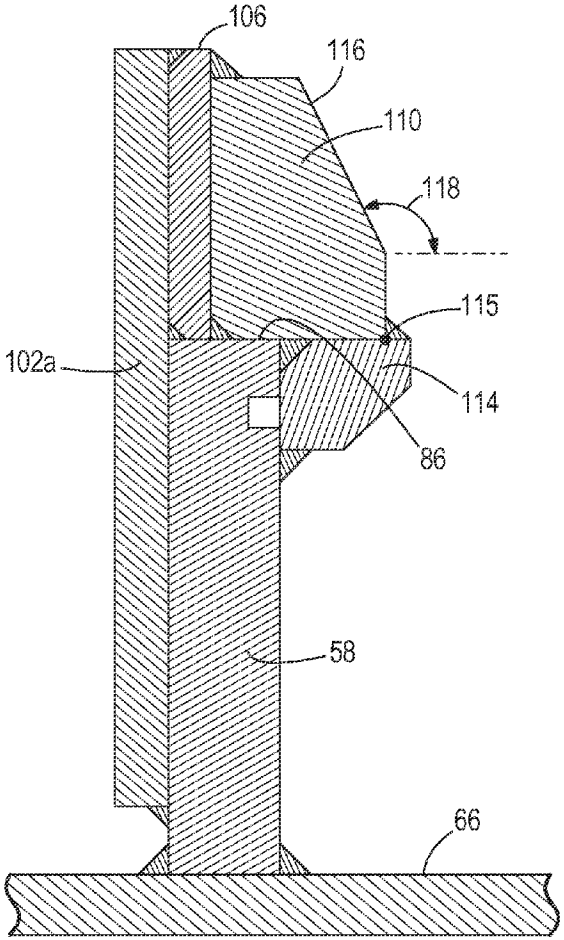
FIG. 7 is a section view of the planar projection of FIG. 6, viewed along section 7-7.

In addition, as best shown in FIGS. 6-8, a reinforcement plate 106 is also secured (e.g., by welding) to at least a portion of each loading plate 102*a*, 102*b*, and to the edge surface 86. In the illustrated embodiment, the reinforcement plate 106 has a thickness that is approximately 37.5% of the thickness of the vane 58, is 75% of the thickness of the loading plate 102*a*, and is equal to the thickness of the loading plate 102*b*. In other embodiments, the reinforcement plate 106 may have another thickness that is less than or equal to the thickness of the loading plates 102*a* or 102*b*. In the illustrated embodiment, the combined thickness of the reinforcement plate 106 and the loading plate 102*a* is approximately 87.5% the thickness of the vane 58, and the combined thickness of the reinforcement plate 106 and the loading plate 102*b* is 75% the thickness of the vane 58. In other embodiments, the reinforcement plate 106 and the loading plates 102*a* or 102*b* may have a combined thickness that is less than or equal to the thickness of the vane 58 at the edge surface 86. In some embodiments, increasing the thickness of the reinforcement plate 106 will increase the natural frequency of the cutter head 38.

Referring now to FIGS. 3 and 5-8, each vane 58 also includes gussets 110 positioned on the edge surface 86 and secured (e.g., by welding) between the edge surface 86 and one of the reinforcement plates 106. As best shown in FIGS. 7 and 8, a shelf portion 114 may be secured to the vane 58 to increase the surface area of the edge surface 86 and increase the area for coupling the cutting bit assembly 62 and the gusset 110 to the edge surface 86. In the illustrated embodiment, the vane 58 includes one gusset 110 for each cutting bit assembly 62 (FIG. 3). The illustrated gusset 110 includes a front surface 111 that faces an adjacent cutting bit assembly 62 with the front surface 111 including an edge 115 located horizontally away from the vane 58 and adjacent the shelf portion 114. In particular, the gussets 110 located adjacent the loading plates 102*a* (FIG. 7) includes an edge 115 contacting the shelf portion 114, whereas the gussets 110 located adjacent the loading plates 102*b* (FIG. 8) include an edge 115 extending beyond the shelf portion 114. The illustrated gussets 110 further includes an angled edge surface 116 positioned away from the reinforcement plate 106. In the illustrated embodiment, the angled edge surface 116 includes an angle 118 of about 116 degrees relative to the edge surface 86. In some embodiments, the angle 118 may be between about 100 degrees and about 140 degrees. In some embodiments, the angle 118 may be between about 110 degrees and about 130 degrees.

Figure 9:
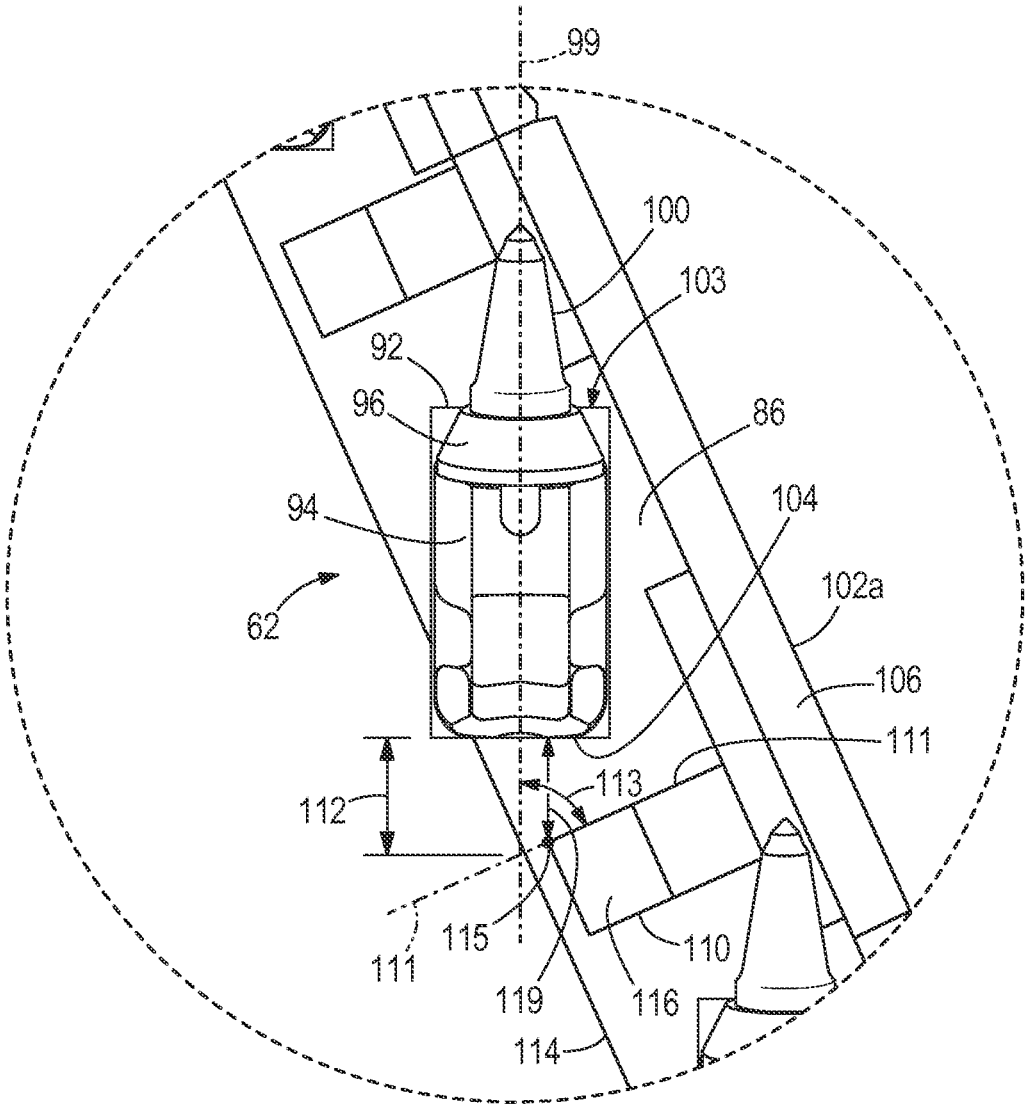
FIG. 9 is a detailed view of FIG. 6.

With reference to FIG. 5, the rear end 104 of the holder block 94 is positioned relative to the edge 115 of the gusset 110 at a first angle 117 measured from the rotational axis 78. In the illustrated embodiment, the first angle 117 is about 3 degrees. In other embodiments, the first angle 117 may be between about 1 degree and 10 degrees. With reference to FIG. 9, the front surface 111 of each gusset 110 is spaced from the rear end 104 of the holder block 94 by a distance 112. In particular, the distance 112 is defined along the central axis 99 between the rear end 104 and a plane that defines the front surface 111. In the illustrated embodiment, the distance 112 is about 54 millimeters. In other embodiments, the distance 112 may be between about 20 millimeters and about 100 millimeters. In addition, the central axis 99 is oriented at an angle relative to the loading plate 102, and the central axis 99 is oriented at a second angle 113 relative to the plane defined by the front surface 111 of the gusset 110. In the illustrated embodiment, the second angle 113 is about 69 degrees. In other embodiments, the second angle 113 may be between about 60 degrees and 80 degrees. Further, a distance 119 measured parallel to the central axis 99 is defined between the edge 115 and the rear end 104 of the holder block 94. In the illustrated embodiment, the distance 119 is about 51.7 millimeters. In some embodiments, the distance 119 may be between about 30 millimeters and about 70 millimeters. In some embodiments, the distance 119 may be between about 40 millimeters and about 60 millimeters.

In other embodiments, the vane 58 may include fewer or more gussets 110 than one gusset 110 per cutting bit assembly 62, and the gussets 110 may be arranged on the vane 58 in a different manner. In one embodiment, the reinforcement plates 106, the gussets 110, and the loading plates 102 are secured by welds that are capable of resisting a tensile stress of at least 483 MPa. In further embodiments, a rear gusset (not shown) is positioned at the end of the vane 58 proximate the discharge end 70 of the drum 54. In one embodiment, the rear gusset extends the entire length of the vane 58 (e.g., extends downwardly to the outer surface of the drum 54).

In operation as the cutting head 38 engages the mine face 22, the reinforcement plates 106 and the gussets 110 stiffen and increase structural rigidity of the vanes 58 and the loading plates 102, which reduces vibrations in these components. The reinforcement plates 106 significantly thicken the outermost segment of the vanes 58 compared to any vanes of conventional cutting heads. In addition, if the bit 98 breaks (e.g., a portion of the tip 100), a portion of the shank 107 and/or a portion of the sleeve 96 within the through bore 101 of the holder block 94 can be removed through the rear end 104 of the holder block 94 through the rear opening 105. The first angle 117, the distance 112, and the second angle 113 allows enough clearance between the holder block 94 and the gusset 110 for the shank 107 to be removed from the holder block 94 between the rear end 104 and the gusset 110. For example, an operator uses a tool (e.g., a punch, a screwdriver, or the like) inserted into the through bore 101 through the forward end 103 to remove the shank 107 through the rear end 104. The gussets 110 are positioned such that they do not obstruct the operator from removing portions of a broken bit 98 from the rear end 104.

Figure 10:
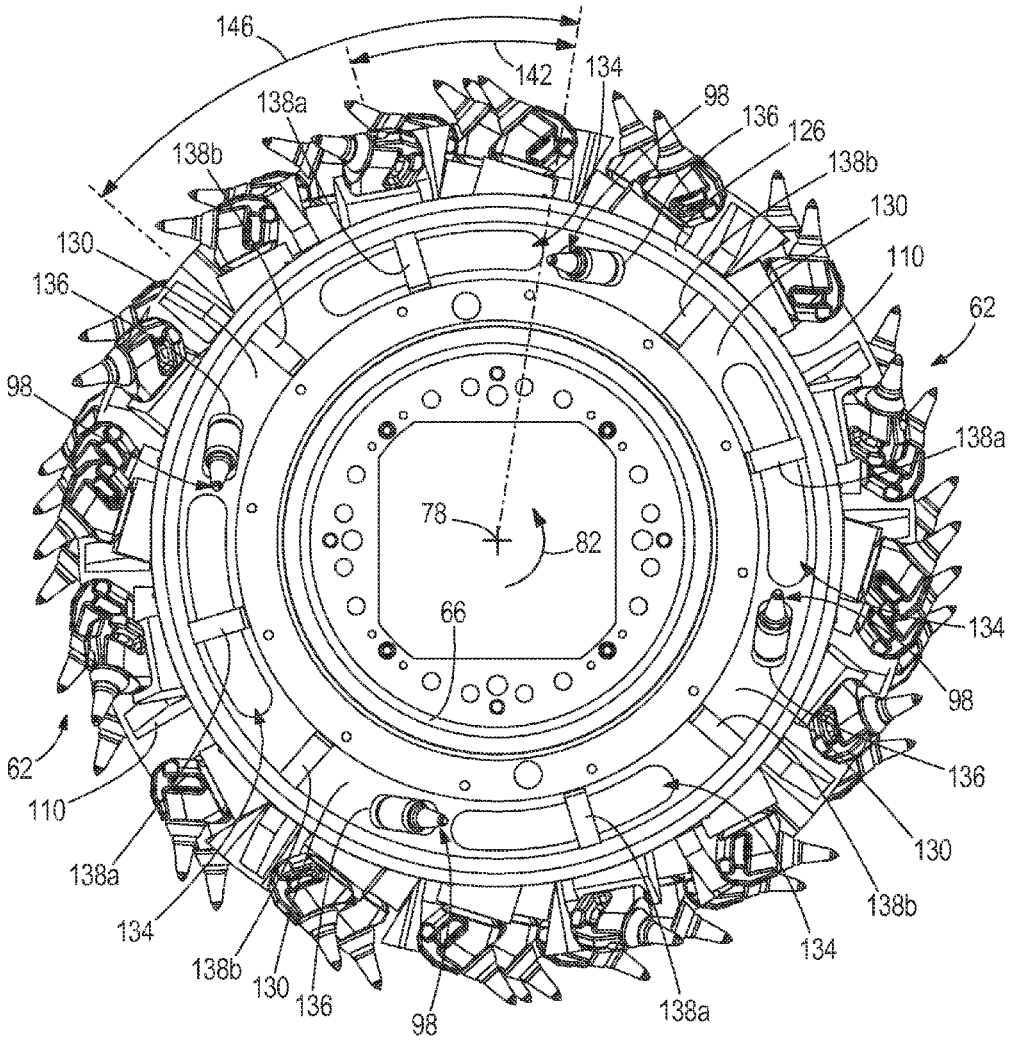
FIG. 10 is an end view of the cutter head of FIG. 3.

With reference to FIGS. 3 and 10, the drum 54 further includes a face ring 126 positioned proximate the face end 74. In the illustrated embodiment, the face ring 126 is concentric with the drum axis 78 and has a diameter that is larger than the cylindrical portion 66 of the drum 54. The illustrated face ring 126 is connected to the cylindrical portion 66 by a web 130 positioned around the perimeter of the cylindrical portion 66. The illustrated web 130 defines four arcuate openings 134 with a hole 136 positioned between adjacent arcuate openings 134 such that a bit 98 extends through the surface of the web 130 and away from the face end 74. The arcuate openings 134 are arranged at 90 degree intervals. In other embodiments, the drum 54 may include fewer or more webs 130 and arcuate openings 134, and the web 130 may include fewer or more holes 136, or no holes 136 at all, and/or the arcuate openings 134 may be arranged in a different manner.

Figure 12:
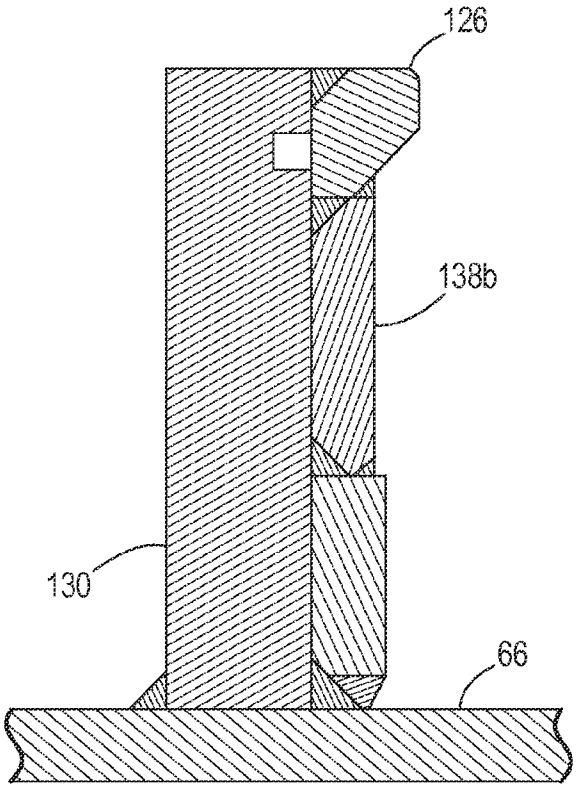
FIG. 12 is a section view of the planar projection of FIG. 6, viewed along section 12-12.
Figure 11:
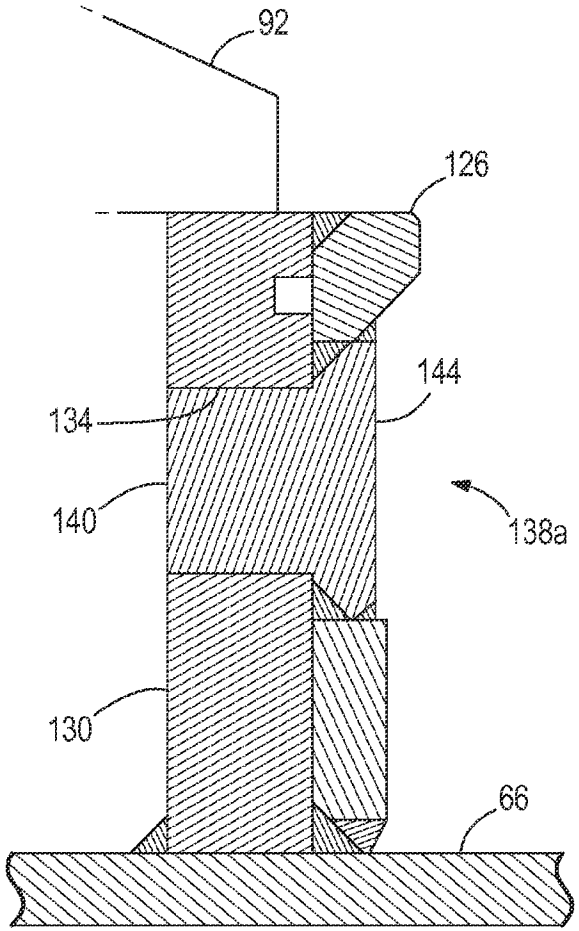
FIG. 11 is a section view of the planar projection of FIG. 6, viewed along section

Ribs 138 are positioned at the face end 74 and extend between the face ring 126 and the cylindrical portion 66. In the illustrated embodiment, eight ribs 138 are positioned around the perimeter of the cylindrical portion 66. The illustrated ribs 138 are arranged in two sets of four ribs **138*a*, 138*b*, and the ribs 138 of each set are arranged at 90 degree intervals. Each of the ribs 138*a* extend across one of the arcuate openings 134. With reference to FIG. 11, the ribs 138*a* are generally defined by T-shaped members including a body portion 140 and a head portion 144 with the body portion 140 received within an arcuate opening 134. With reference to FIG. 12, the ribs 138*b* are coupled directly to the web 130 and include a uniform cross-section (e.g., generally rectangular in cross-section). In other embodiments, the face ring 126 may include a rib 138 for each bit 98 extending through a hole 136. In other embodiments, the ribs 138*a*, 138*b*** may have other constructions.

In continued reference to FIG. 10, one set of ribs **138*a* are offset from an end of one arcuate opening 134 by a third angle 142 (e.g., the ribs 138*a* are not centrally located within the arcuate opening 134), and a second set of ribs 138*b* are offset from the end of the arcuate opening 134 by a fourth angle 146. The ribs 138*a*, 138*b* are positioned forward of a rear end of the arcuate opening 134, or offset in the first direction 82 of rotation of the drum 54. In one embodiment, the third angle 142 is approximately 26 degrees and the fourth angle 146 is approximately 58 degrees. As such, an angle between one of the ribs 138*b* and an adjacent rib 138*a* is about 32 degrees, and an angle between the same rib 138*b* and the other adjacent rib 138*a* is about 58 degrees. In other words, an angular spacing between adjacent ribs 138*a*, 138*b* is non-uniform. In other embodiments, the third angle 142 is between 10 degrees and 45 degrees. In other embodiments, the fourth angle 146** is between 40 degrees and 75 degrees.

In one embodiment, adjacent ribs 138 are spaced apart by alternating angles. That is, a second rib 138 is separated from a first rib 138 by a first angle, a third rib 138 is separated from the second rib 138 by a second angle, a fourth rib 138 is separated from the third rib 138 by the first angle, etc. In one embodiment, the first angle is approximately 32 degrees and the second angle is approximately 58 degrees. In other embodiments, the first angle is between 10 degrees and 45 degrees. In other embodiments, the second angle is between 40 degrees and 75 degrees.

In other embodiments, the drum 54 may include fewer or more ribs 138, and/or the ribs 138 may be arranged in another manner relative to the axis 78.

The illustrated reinforcement plates 106, the gussets 110, and the ribs 138 stiffen the structure of the cutter head 38 and reduce the noise output caused by vibration of the cutter head 38 by approximately 3 dBA. In one embodiment, the noise output is reduced from 103 dBA to 100 dBA, which approximately doubles the allowable exposure time for mine personnel. In addition, the weights of the reinforcement plates 106, gussets 110, and ribs 138 are relatively small and minimally impact the performance of the cutter head 38, if at all.

Thus, the invention provides, among other things, a cutter head for a longwall shearer. Although the invention has been described in detail with reference to certain preferred embodiments, variations and modifications exist within the scope and spirit of one or more independent aspects of the invention as described.

The invention claimed is:

1. A cutter head for a mining machine, the cutter head comprising:

a drum including a first end, a second end, and an outer surface, the drum rotatable about a drum axis extending between the first end and the second end;

a vane coupled to the outer cylindrical surface extending away from the drum axis;

a cutting bit assembly positioned adjacent the vane, the cutting bit assembly including a bit and a holder block, the bit including a tip portion and a shank portion, the shank portion received within the holder block along a central axis, the holder block including a forward end adjacent the tip portion, a rear end opposite the forward end, and a transverse opening positioned between the forward end and the rear end, the transverse opening permitting access to a rear end of the shank portion, the holder block further including a rear opening; and a gusset coupled to the vane and spaced from the rear end of the holder block, wherein when the bit is broken, a portion of the bit is removable from the holder block through the rear opening and between the rear end of the holder block and the gusset; and wherein the gusset includes a front surface terminating at an edge positioned away from the vane, and wherein the edge of the front surface of the gusset is positioned between the central axis and the vane.

2. The cutter head of claim 1, wherein the front surface extends away from the vane, and wherein an angle about the drum axis between the rear end of the holder block and the edge of the front surface is at least about 3 degrees.

3. The cutter head of claim 1, wherein the front surface defines a plane, and wherein an angle between the central axis and the plane is about 69 degrees.

4. The cutter head of claim 1, wherein a distance between the rear end of the holder block and a plane of the front surface of the gusset measured along the central axis is at least about 54 millimeters.

5. The cutter head of claim 1, wherein the gusset is also coupled to a reinforcement plate extending parallel to the vane, and wherein a thickness of the reinforcement plate is about 37.5% of the thickness of the vane.

6. The cutter head of claim 5, further comprising a loading plate coupled to the vane such that the reinforcement plate is positioned between the gusset and the loading plate.

7. The cutter head of claim 6, wherein a thickness of the loading plate is about equal to the thickness of the reinforcement plate.

8. The cutter head of claim 6, wherein a ratio of the thickness of the reinforcement plate to the thickness of the loading plate is at least about 75%.

9. The cutter head of claim 1, further comprising a shelf portion coupled to the vane and extending generally perpendicular to the vane, the cutting bit assembly secured to the shelf portion, wherein a portion of the gusset contacts the shelf portion.

10. The cutter head of claim 1, wherein the second end of the drum is configured to be spaced apart from a mine face and the first end is configured to be positioned between the mine face and the second end.

11. The cutter head of claim 1, wherein the vane includes a loading surface extending in a helical manner along the drum axis, the loading surface configured to engage and urge cut material from the first end of the drum toward the second end of the drum.

12. The cutter head of claim 1, wherein the front surface defines a plane oriented at an acute angle relative to the central axis.

13. The cutter head of claim 12, wherein the angle between the plane and the central axis is between approximately 60 degrees and approximately 80 degrees.

14. The cutter head of claim 1, wherein a distance between the rear end of the holder block and a plane of the front surface of the gusset measured along the central axis is between approximately 20 millimeters and approximately 100 millimeters.

15. The cutter head of claim 1, wherein the central axis is oriented at an oblique angle relative to the vane, the cutting bit overlapping the vane.

16. A cutter head for a mining machine, the cutter head comprising:

a drum including a first end, a second end, and an outer surface, the drum rotatable about a drum axis extending between the first end and the second end;

a vane coupled to the outer cylindrical surface extending away from the drum axis;

a cutting bit assembly positioned adjacent the vane, the cutting bit assembly including a bit and a holder block, the bit including a tip portion and a shank portion, the shank portion received within the holder block along a central axis, the holder block including a forward end adjacent the tip portion, a rear end opposite the forward end, and a transverse opening positioned between the forward end and the rear end, the transverse opening permitting access to a rear end of the shank portion, the holder block further including a rear opening; and a gusset coupled to the vane and spaced from the rear end of the holder block, wherein when the bit is broken, a portion of the bit is removable from the holder block through the rear opening and between the rear end of the holder block and the gusset; and wherein the central axis is oriented at an oblique angle relative to the vane, and wherein the cutting bit overlaps the vane.

17. The cutter head of claim 16, wherein the second end of the drum is configured to be spaced apart from a mine face and the first end is configured to be positioned between the mine face and the second end.

18. The cutter head of claim 16, wherein the vane includes a loading surface extending in a helical manner along the drum axis, and wherein the loading surface is configured to engage and urge cut material from the first end of the drum toward the second end of the drum.

19. The cutter head of claim 16, wherein the gusset includes a front surface defining a plane oriented at an acute angle relative to the central axis.

20. The cutter head of claim 16, wherein the gusset includes a front surface terminating at an edge positioned away from the vane, and wherein the edge of the front surface of the gusset is positioned between the central axis and the vane.

* * * * *